United States Patent [19]

List et al.

[11] 3,994,444

[45] Nov. 30, 1976

[54] STRAND WINDING

[75] Inventors: Ralph W. List, East Lansdowne; Robert K. Stanley, Media, both of Pa.

[73] Assignee: Textured Yarn Co., Inc., Kennett Square, Pa.

[22] Filed: Jan. 20, 1975

[21] Appl. No.: 542,503

Related U.S. Application Data

[62] Division of Ser. No. 467,018, May 6, 1974, Pat. No. 3,936,006.

[52] U.S. Cl. ..... 242/18 A; 242/18 PW; 242/43 R

[51] Int. Cl.[2] ..... B65H 67/04

[58] Field of Search ..... 242/18 A, 18 PW, 18 DD, 242/43 R, 25 A

[56] References Cited

UNITED STATES PATENTS

| | | | |
|---|---|---|---|
| 2,296,339 | 9/1942 | Daniels | 242/18 A |
| 3,318,541 | 5/1967 | Genson | 242/18 A |
| 3,345,003 | 10/1967 | Mattingly et al. | 242/18 A |
| 3,690,575 | 9/1972 | Ito et al. | 242/18 A |

*Primary Examiner*—Stanley N. Gilreath
*Attorney, Agent, or Firm*—Miller, Frailey & Prestia

[57] ABSTRACT

Package winding of textile strands uninterrupted by transfer from a full to an empty package is accomplished by delaying lateral transfer of the winding strand from a full to an empty package and by picking up a resulting transfer tail of the laterally transferring strand adjacent the end of the empty package. The transfer delay step utilizes a bistable inertial device located to intercept the laterally transferring strand and to be repositioned thereby and to release the strand after momentary inertia-induced delay during which the strand begins to wind onto the empty package. The pickup step utilizes rotary devices located at the spaced adjacent ends of spindles for the respective packages, such device on the spindle of the package to which the strand is transferring being adapted to engage and grip it. The strand is broken or otherwise severed between the pickup device and the full package, thereby enabling the strand to be traversed onto the empty package.

9 Claims, 10 Drawing Figures

STRAND WINDING

This is a division, of application Ser. No. 467,018 filed May 6, 1974, now U.S. Pat. No. 3,936,006.

This invention relates to package winding of textile strands uninterrupted by transfer from a full to an empty package.

Modern machinery for package winding of textile strands usually provides for transfer of the strand being wound from winding onto one package to winding onto an adjacent package without interruption in the winding operation. This enables a full package to be doffed while the strand is being wound onto a new package. Various arrangements are known for rendering the strand transfer from one package to another more automatic than manual, but none that can be relied upon to the degree desired. Malfunction of automatic transfer from a full to an empty bobbin is wasteful and may necessitate shutting down the winding machine—an added unproductive expense.

A primary object of the present invention is positive transfer of a winding strand from one package to another while maintaining continuity of winding.

Another object of this invention is automatic provision and capture of a transfer tail of strand being transferred from winding onto a full package to being wound onto an empty package.

A further object is unaided breaking of the strand between packages during such transfer.

Other objects of the present invention, together with means and methods of attaining the various objects, will be apparent from the following description and the accompanying diagrams of a preferred embodiment presented by way of example rather than limitation.

Figure 1:
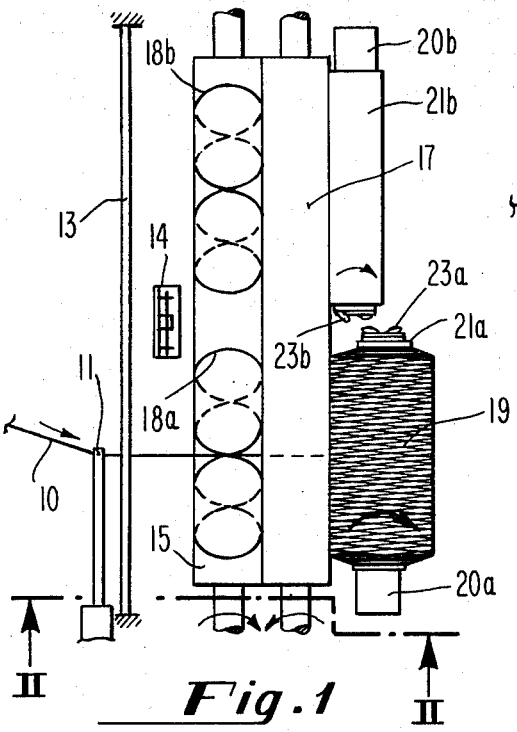
FIG. 1 is a plan view of strand-winding apparatus according to this invention.

In general, the objects of the present invention are accomplished, in package winding of textile strands including transfer from winding onto a first package to winding onto a second package without interruption, wherein the packages are movable individually into and out of mutual axial alignment with their adjacent ends closely spaced and into and out of rotatively driven position, the degree of such alignment when one package is full and the other is empty, while both are being surface driven by a common roll, depending upon relative package size but being substantial; the strand being traversed along the winding onto the first package after passing through a remote guiding location temporarily fixed substantially midway and in advance of the winding surface of the package, is transferred to a new guiding location similarly related to the second package, whereupon the strand stops winding onto the first package and starts winding onto the second package without interruption in winding operations. More particularly, this is done by aligning a second package substantially coaxially with the first package and rotating the second package similarly to the first package, transferring the remote guiding location from an extended lateral bisector of the first package to an extended lateral bisector of the second package, then momentarily delaying the corresponding lateral transfer of the winding strand substantially midway thereof, rotatively gripping the laterally transferring strand at the end of the second package adjacent an end of the first package, whereupon continuing rotation or withdrawal of the first package is effective to cause the strand therebetween to tighten and break and the laterally transferring strand is wound onto a marginal surface portion of the second package during such delay and is traversed therealong subsequent to such delay.

This invention provides improved apparatus for uninterrupted package winding of textile strands including transfer from traverse winding onto a first package to traverse winding onto a second package substantially axially aligned therewith, the respective packages being carred upon respective spindles and individually movable into contact with rotative drive means with their adjacent ends closely spaced and out of mutual contact. Such apparatus comprises a strand guide locatable on an extended lateral bisector of either package, an inertial flip-flop device located between the respective extended lateral bisectors and adapted to be contacted by the laterally transferring strand when the strand guide is transferred from one extended lateral bisector to the other and thereby to delay the lateral transfer of the strand momentarily in alignment with a marginal portion of the second package to wind thereon before engaging means for traversing the strand relative to the second package, and pickup means at the adjacent ends of the respective spindles for engaging and gripping strand being laterally transferred from the package on the opposite spindle.

The various views of the appended drawings illustrate the features of winding apparatus in which this invention is localized, without showing conventional driving, guiding, supporting, and supply elements, which would merely add distracting detail unnecessary to an understanding of the invention. Details of single-position package winding using a slotted traverse roll and an intermediate roll may be found in U.S. Pat. No. 3,374,960 of one of the present inventors.

Figure 2:
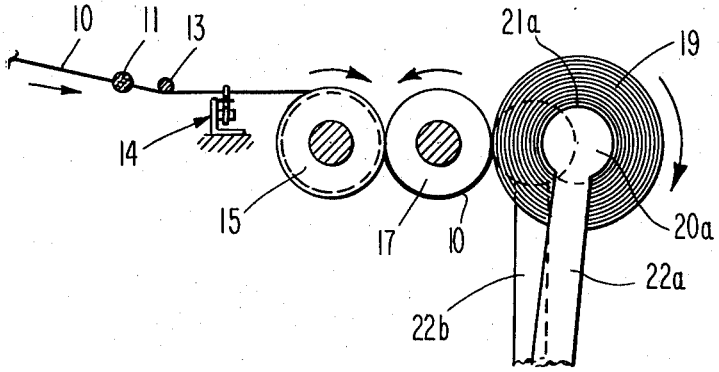
FIG. 2 is an end elevation of the same apparatus, taken at II—II on FIG. 1 and shown on an enlarged scale.

FIG. 1 shows in plan, and FIG. 2 in left side elevation, apparatus of this invention with left and right winding positions and strand being wound at the left position. Strand 10 proceeds from a source (not shown) at the left of the view (rear of the machine, from a machine operator's point of view) as indicated by an arrow. The strand proceeds through positionable eye guide 11, under guide bar 13, into (from the top) and through a slot in the surface of helically slotted traverse roll 15, under intermediate roll 17, and onto winding package 19—shown at an intermediate stage between empty and full.

Package 19 comprises bobbin 21*a* on spindle 20*a* supported on left swing arm 22*a*. Right swing arm 22*b* (FIG. 2) supports spindle 20*b*, which carries empty bobbin 21*b*. Traverse roll 15 has a pair of helical traverse slot patterns 18*a* and 18*b*, one centered relative to bobbin 21*a* and the other centered relative to bobbin 21*b*. Eye guide 11 is at the end of guide rod 12, which is shown located on the lateral bisector of package 19, midway of left traverse pattern 18*b*; it may be relocated on the lateral bisector of the package to be formed on the empty bobbin, as shown in a later view. Also visible in FIG. 1 are tail pickup devices 23*a* and 23*b* carried on adjacent ends of the respective bobbin spindles, as well as lateral transfer delay device 14 of bistable inertial type located midway from side to side and between guide rod 12 and traverse roll 15, details thereof being visible in subsequent views.

Figure 3:
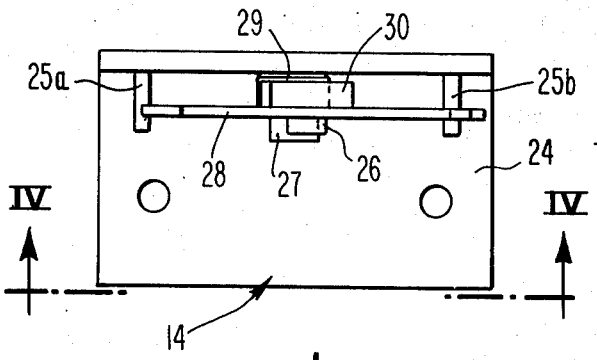
FIG. 3 is a plan view, on a further enlarged scale, of an apparatus component shown in the preceding views.
Figure 4:
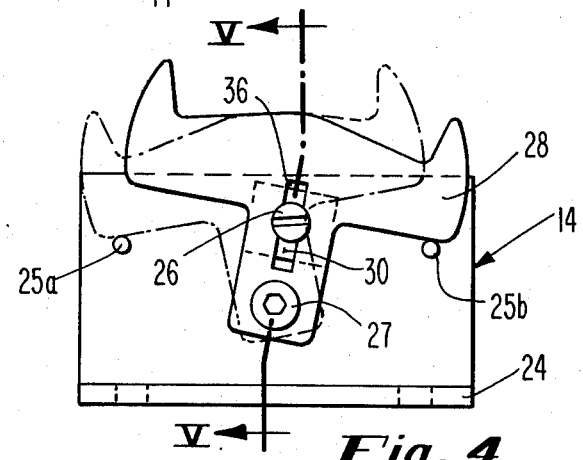
FIG. 4 is a front elevation of the apparatus of FIG. 3, taken at IV—IV thereon.
Figure 5:
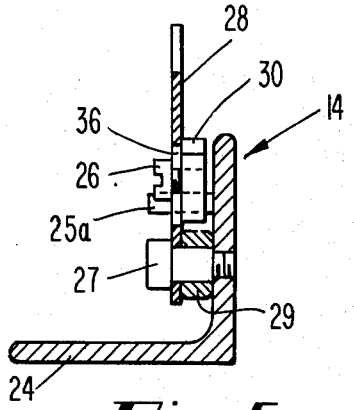
FIG. 5 is a side sectional elevation of the apparatus of FIGS. 3 and 4, taken at V—V on FIG. 4.

FIGS. 3, 4, and 5 show bistable inertial delay device 14 in plan and in front and side elevation, including mounting bracket 24 having a base with holes therein to receive suitable mounting means, and an upright part furnished with stop pins 25*a* and 25*b* at the left and right. Pivot pin 27 is threaded horizontally into the lower part of the upright, on a vertical center line. Washer 29 on the latter pin is located between the bracket upright and the base portion of generally Y-shaped flip-flop 28 pivotably supported at its base on the pivot pin. Also vertically aligned is slot 36 with retaining pin 26 extending therethrough and into a threaded bore in weight 30 retained thereby at adjustable height above the pivot pin.

The arms of the flip-flop extend upward to such an extent that, when it is tilted against a stop pin at one side, its arm on the opposite side is at a strand-engaging height, while the arm on the near side is below such height. The respective arms are located in perpendicular alignment with marginal portions of the respective bobbins offset laterally beyond the sweep of the respective traverse roll slotting. As shown, the flip-flop is tilted to the right, with the alternative left tilted position indicated in broken lines in FIG. 4 only. If desired, the flip-flop may be visualized as T-shaped with upwardly extending ears at the ends of its cross-bar, which has a somewhat convex upper surface therebetween.

Figure 6:
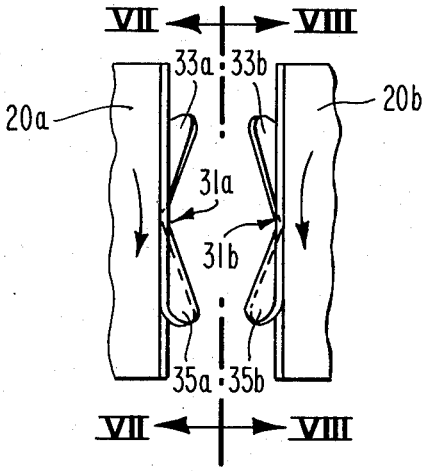
FIG. 6 is a fragmentary enlarged view, in either plan or elevation, of adjacent apparatus components shown in FIGS. 1 and 2.
Figure 7:
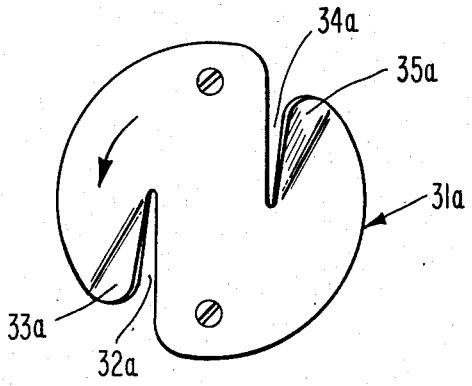
FIG. 7 is an end elevation taken at VII—VII on FIG. 6, omitting apparatus more remote than the device nearest the viewer.
Figure 8:
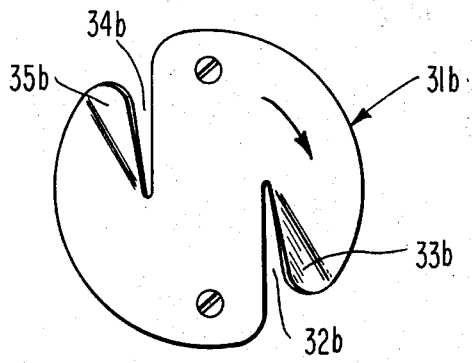
FIG. 8 is an end elevation similar to the preceding view but taken at VIII—VIII on FIG 6.

FIGS. 6, 7, and 8 show strand pickup devices 31*a* and 31*b* secured, respectively, to the right end of left spindle 20*a* and to the left end of right spindle 20*b* as shown in the first of these views, and shown individually in respective FIGS. 7 and 8. Each such device is essentially a disc, generally S-shaped in flat view, and with the terminal portions or ears of the respective S's bent from about 10° to 30° out of the plane of their own disc and toward the opposite disc. The terminal portions are spaced from the body of the disc by slots that narrow inward. Thus, left pickup disc 31*a* has slots 32*a* and 34*a*, and bent ears 33*a* and 35*a*, while right pickup disc 31*b* has slots 32*b* and 34*b*, and bent ears 33*b* and 35*b*. It will be understood that strand 10 is engaged and gripped in the slots between the ears and body of one or the other of the pickup discs at the time of lateral transfer, as described further below.

Figure 9:
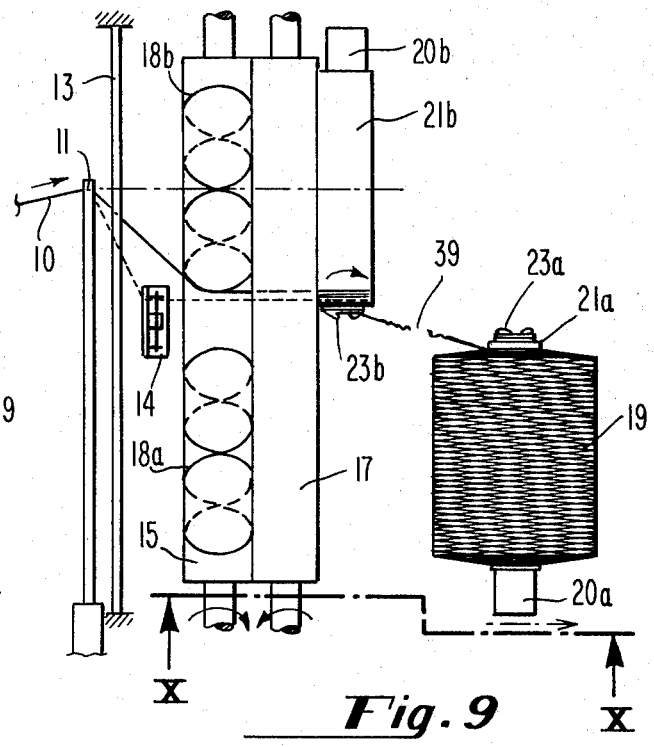
FIG. 9 is a plan view similar to FIG. 1 but taken just after transfer of the strand from winding onto a full package to an empty package.
Figure 10:
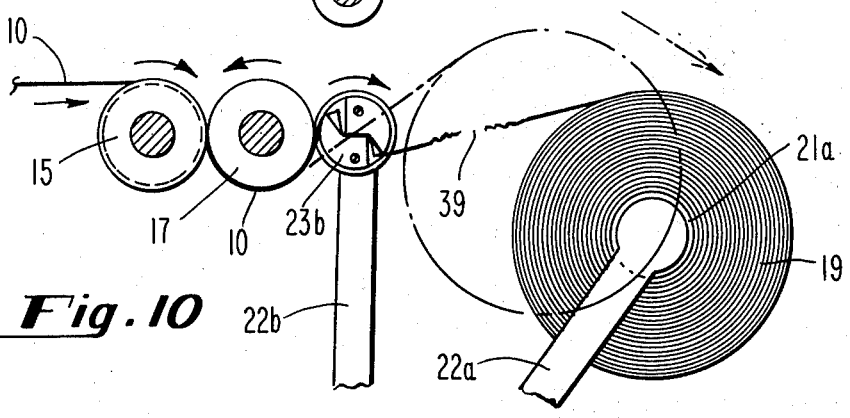
FIG. 10 is an enlarged left side elevation corresponding to FIG. 9.

FIGS. 9 and 10 show the apparatus and strand in views similar to FIGS 1 and 2 but just after transfer from full package 19 wound on left bobbinn 21*a* and before completion of transfer to winding onto empty bobbin 21*b*. With empty righthand bobbin 21*b* in surface contact with rotating intermediate roll 17, eye guide 11 is moved from its position on an extended lateral bisector of package 19 (FIG. 1) on bobbin 21*a* to a new position on a similarly extended lateral bisector (dot-dashed line) of bobbin 21*b*. The laterally moving strand ceases winding onto package 19 and "slides" off the end and toward the winding axis, where it encounters pickup device 23*b* on the adjacent end of spindle 20*b*. (The bulk of the package helps shield it from engaging pickup device 23*a* on package spindle 20*a*). The slight lateral delay provides a semi-slack condition in the strand, which is still being fed at constant rate to the winding position, so that enough of it wraps as a transfer tail onto the pickup device to retain it. In being moved by the guide, strand 10 encounters flip-flop 28 of inertial delay device 14, which temporarily delays the lateral transfer with the strand perpendicularly aligned with a marginal portion of the empty bobbin, (as indicated by a broken line) whereupon the strand "climbs" from its position of retention by the pickup device and over the end onto that marginal portion, being supplied thereto from the intermediate roll surface. Then the flip-flop tilts toward the lateral direction in which the strand is being moved, whereupon the strand disengages from the flip-flop and moves to the position shown in solid line. The transferred strand then falls into the slot of traverse roll 15 and is traversed to and fro thereby along the surface of the empty bobbin to form a new package thereon.

Swing arm 22*a* mounting the full package spindle is swung outward, usually by the machine operator or tender, to lift the package away from the rotating intermediate roll. As shown at break 39 in FIGS. 9 and 10, the strand tautens between package 19 and pickup device 23*b* because of the continued rotation and/or the swinging away of the package to such an extent that it actually breaks. Alternatively, a severing device (not shown) of knife or scissors type may be actuated in unison with the swing arm to cut the strand at the indicated break location. The full package can then be doffed, and an empty bobbin substituted. Of course, when the forming righthand package becomes full, the strand is transferred laterally back to its initial position, thereby starting a new package on the empty bobbin substituted there.

The strand transfer provided according to this invention has proved to be very positive and to require no operator intervention to assure strand pickup and winding at the transferred location. Wastage of strand by reason of incomplete transfer is essentially eliminated. The resulting advantages and benefits are apparent.

Although a preferred embodiment has been illustrated and described, modifications may be made therein, as by adding, combining, or subdividing parts or steps, or substituting equivalents, while retaining significant advantages and benefits of the invention, which itself is defined in the following claims.

The claimed invention is:

1. In package winding of textile strands including transfer from winding onto a first package to winding onto a second package without interruption, wherein the packages are movable individually into and out of mutual axial alignment with their adjacent ends closely spaced and into and out of rotatively driven position, and wherein the strand is traversed along and onto the winding package after passing through a remote guiding location to the winding surface of the package, the improvement in transferring a strand from winding onto one package to winding onto the other package without interruption, comprising aligning a second package substantially coaxially with the first package and rotating the second package similarly to the first package, transferring the remote guiding location from a first locus substantially midway and in advance of the first package to an alternative locus similarly related to the second package, meanwhile momentarily delaying via mechanical inertia alone the corresponding lateral transfer of the winding strand at a locus substantially midway thereof and in perpendicular alignment with a marginal surface portion of the second package, rotatively gripping the laterally transferring strand at the end of the second package adjacent an end of the first package, winding the laterally transferring strand onto such marginal portion during such delay, and traversing the strand onto the winding surface of the second package subsequent to such delay.

2. Package winding according to claim 1, including withdrawing the first package from such substantial alignment with the second package, whereupon such withdrawal or continuing rotation of the first package causes the strand therebetween to tighten and break therebetween.

3. Strand winding according to claim 1, wherein the momentary delay in lateral transferral of the strand involves converting a bistable inertial device located between the respective extended lateral bisectors, from one of its stable positions to the other thereof by lateral contact with the strand.

4. Strand winding according to claim 1, wherein the gripping of the laterally transferring strand includes rotative engagement therewith in a plane more closely adjacent the end of the package to which the strand is being transferred than to the end of the package from which it is being transferred.

5. In dual-position traverse winding of textile strands, wherein such a strand is forwarded longitudinally and is traversed over either of two laterally spaced traverse paths, the improvement in interchanging the strand between the respective traverse paths comprising removing the winding strand from either of the two traverse paths and guiding it into the other traverse path,meanwhile utilizing mechanical inertia to provide a temporarily fixed strand-guiding locus intermediate the respective traverse paths and constraining the strand to be guided at such locus for a brief period after the strand has left either of the traverse paths and before it reaches the other traverse path.

6. Strand winding according to claim 5, wherein the respective traverse paths are of substantially equal width and are spaced apart less than the width of either traverse path, and including relocating the temporarily fixed strand-guiding locus alternately within opposite end portions of the intermediate space, in each instance nearer the traverse path toward which the strand is being transferred than to the path it has just left.

7. Strand winding according to claim 6, including the step of picking up the strand downstream at a location laterally closer to the strand traverse path toward which the strand is being transferred than to the path it has just left.

8. Strand winding according to claim 7, including the steps of discontinuing winding the strand onto a package aligned downstream of the traverse path that the strand has just left and initiating winding of the strand onto a package aligned downstream of the traverse path toward which the strand is being transferred and in the vicinity of which the strand has just been picked up.

9. Strand winding according to claim 8, including the step of forming a transfer tail of such strand before initiating such winding.

* * * * *